US005453763A

United States Patent [19]

Nakagawa et al.

[11] Patent Number: 5,453,763

[45] Date of Patent: Sep. 26, 1995

[54] STILL PICTURE DISPLAY APPARATUS AND EXTERNAL MEMORY CARTRIDGE USED THEREFOR

[75] Inventors: Katsuya Nakagawa; Satoshi Yamato; Hideki Tanaka, all of Kyoto, Japan

[73] Assignee: Nintendo Co., Ltd., Kyoto, Japan

[21] Appl. No.: 215,977

[22] Filed: Mar. 18, 1994

Related U.S. Application Data

[63] Continuation of Ser. No. 768,273, Nov. 14, 1991, abandoned.

[30] Foreign Application Priority Data

Feb. 2, 1990 [JP] Japan ..... 2-24715

[51] Int. Cl.[6] ..... G09G 1/14

[52] U.S. Cl. ..... 345/192; 345/200

[58] Field of Search ..... 345/192, 193, 345/185, 186, 196, 197, 200, 201, 202, 203; 273/DIG. 28, 434; 358/183; 348/589

[56] References Cited

U.S. PATENT DOCUMENTS

| | | | |
|---|---|---|---|
| 4,180,805 | 12/1979 | Burson | 340/709 |
| 4,368,461 | 1/1983 | Komatsu et al. | 340/703 |
| 4,754,271 | 6/1988 | Edwards | 340/784 |
| 4,824,106 | 4/1989 | Ueda | 340/723 |
| 4,926,372 | 5/1990 | Nakagawa | 364/900 |
| 4,949,298 | 8/1990 | Nakanishi et al. | 364/900 |
| 4,984,193 | 1/1991 | Nakagawa | 364/900 |

FOREIGN PATENT DOCUMENTS

| | | |
|---|---|---|
| 0351912 | 1/1990 | European Pat. Off. . |
| 3346458A1 | 6/1984 | Germany . |
| 56-133790 | 10/1981 | Japan . |

*Primary Examiner*—Richard Hjerpe
*Assistant Examiner*—Xiao M. Wu
*Attorney, Agent, or Firm*—Nixon & Vanderhye

[57] ABSTRACT

A still picture display apparatus comprises a VRAM and a character ROM. The VRAM is allocated first coordinate addresses corresponding to display positions of a raster scan type display, and a character code representing a character to be displayed is stored in each of the first coordinate addresses. The character ROM is divided into a plurality of storage areas, and dot data of the character is stored in an address designated by the above character code in each of the storage areas. An extended RAM is also allocated second coordinate addresses similarly to the VRAM, and modifying data (character modifying data and/or color modifying data) corresponding to the character code stored in the VRAM is stored in each of the second coordinate addresses. The modifying data is read out of the extended RAM and is loaded into a register and then, is applied as a higher order address of the character ROM to designate any one of the storage areas, and the character code read out of the VRAM is applied as a lower order address of the character ROM. Consequently, the dot data of the character corresponding to the character code is read out of the character ROM.

9 Claims, 7 Drawing Sheets

STILL PICTURE DISPLAY APPARATUS AND EXTERNAL MEMORY CARTRIDGE USED THEREFOR

This is a continuation of application Ser. No. 07/768,273, filed Nov. 14, 1991, now abandoned.

TECHNICAL FIELD

The present invention relates to a still picture display apparatus and an external memory cartridge used therefor. More particularly, the present invention relates to a still picture display apparatus for combining a moving picture and a still picture and displaying an image on a raster scan type display, for example, a television game set, which is improved so as to remove the restriction in displaying a still picture in a text system and an external memory cartridge.

PRIOR ART

As one example of image display devices for combining a moving picture and a still picture and displaying an image on a raster scan type display, a television game set disclosed in Japanese Patent Laid-Open Gazette No. 118,184/1984 (U.S. Pat. No. 4,824,106) has been known.

In this prior art, when a still picture (or a background picture) is displayed, the principle of a text system utilizing a video RAM and a character ROM is used. For example, when one character is constituted by 8×8 dots (pixels), a video RAM (abbreviated as "VRAM" hereinafter) having addresses corresponding in position to 32×30 (960) cells obtained by dividing a screen of the raster scan type display in the horizontal and the vertical directions. Furthermore, in the character ROM, dot (font) data, that is, graphic data of a character is stored in an address specified by a character code (or a character number). A character code of a character is written into a coordinate address of the VRAM corresponding to a position on the screen on which the character is to be displayed, and the character code is read out of the VRAM in synchronization with the scanning of the scan type display. The character ROM is addressed by the character code, thereby to read the dot (font) data of the character out of the character ROM. The dot data read out is converted into a video signal and the video signal is applied to the raster scan type display, thereby to display a still picture constituted by a desired character on a desired position on the screen.

In the technique disclosed in Japanese Patent Laid-Open Gazette No. 118,184/1984, the number of characters which can be displayed on one screen (one frame) is limited to 254. The reason for this is that only $2^8$=256 (FF in hexadecimal notation) character codes can be designated at one time when a data bus is 8 bits.

On the other hand, if the number of bits of a data bus of a CPU for image processing is increased to, for example, 16 and the number of bits of an address bus thereof is also increased, the number of characters which can be displayed on one screen can be increased to $2^{16}$. In this case, however, compatibility with the type of television game set presently on the market is lost.

Furthermore, the utilization of the technique of increasing the storage capacity of the character ROM and switching banks in units of 256×16 bytes=4, 096 bytes is also considered. Even in this case, however, the maximum number of characters which can be displayed on one screen (one frame) remains 256. If the number of characters which can be displayed on one screen is not less than 256, the CPU must regularly monitor the bank switching condition and rewrite data in a bank data register when it detects the bank switching condition, thereby increasing the burden on the CPU. Moreover, banks cannot be switched for each display coordinate position on one screen. Accordingly, in, for example, a text adventure game and a simulation game using kanji characters, the number of characters which can be displayed on one screen must be large, thereby to make it impossible to play a high-level game and represent an image.

On the other hand, in a television game set ("Family Computer" or "Nintendo Entertainment System" (trade name)) sold by the presently of the present invention to which the technique disclosed in Japanese Patent Laid-Open Gazette No. 118,184/1984 is applied, the colors of characters constituting a still picture can be designated only in units of 4 (2×2) characters. The reason for this is as follows. More specifically, a VRAM of 1,024 bytes (generally, 1K byte) is utilized so as to display 960 characters. However, 960 bytes are required to designate character codes and thus, the remaining 64 bytes must be used to designate the colors. On the other hand, if it is desired that four colors can be selected per one character, two bits are required for each character. Consequently, if 64×8=512 bits are used to designate the colors of the 960 characters, only two bits can be used per four characters. In order to designate colors for each character, therefore, the capacity of the VRAM on the side of the main unit may be increased. Also in this case, however, compatibility with the type of television game set presently on the market is lost.

Consequently, in the prior art, the representation of a still picture is restricted. For example, the number of characters which can be displayed on one screen (that is, on one frame) is small, and colors cannot be designated for each character. Accordingly, it is desired to improve the capability to represent an image.

SUMMARY OF THE INVENTION

Therefore, an object of the present invention is to provide a still picture display apparatus using a text system but capable of significantly relaxing the restriction of the representation of a still picture and improving the capability to represent an image.

Another object of the present invention is to provide an external memory cartridge used for a still picture display apparatus capable of significantly relaxing the restriction of the representation of a still picture and improving the capability to represent an image while maintaining compatibility with at least the existing image processing unit for displaying a still picture.

A still picture display apparatus according to the present invention comprises character storing means (which corresponds to a character memory 22 in an embodiment shown in FIG. 1), first writable/readable storing means (a VRAM 13), second writable/readable storing means (an EXRAM 25), program storing means (a program memory 21), write processing means (a CPU 11 and a PPU 12), writing means (an EXRAM write control circuit 23), reading means (an EXRAM read control circuit 24), temporary storing means (a register 26), and output processing means (a PPU 12).

An external memory cartridge according to the present invention is detachably mounted on a still picture display apparatus comprising first writable/readable storing means (a VRAM 13), write processing means (a CPU 11 and a PPU 12) and output processing means (a PPU 12), and comprises second writable/readable storing means (an EXRAM 25), program storing means (a program memory 21), writing means (an EXRAM write control circuit 23), reading means (an EXRAM read control circuit 24), and temporary storing means (a register 26).

The above described character storing means is divided into a plurality of storage areas, and dot data (or font data or graphic data) of a character is stored in an address designated by a character code (or a character number) in each of the storage areas. Any one of the plurality of storage areas is designated by a higher order address of addresses applied to the character storing means, and a character code is applied as a lower order address. The first writable/readable storing means is allocated first coordinate addresses corresponding to the above described cells on the screen of the scan type display. Into and out of each of the first coordinate addresses, a character code of a character to be displayed in the position is written by the first writing means and read out by the second reading means.

Furthermore, the second writable/readable storing means is also allocated second coordinate addresses corresponding to the cells on the screen of the scan type display, similarly to the first writable/readable storing means. Modifying data is written into the second coordinate address. The modifying data is read out by the first reading means and is temporarily stored in the temporary storing means.

The character code read out of the first writable/readable storing means and the modifying data temporarily stored in the temporary storing means are respectively applied as a lower order address and a higher order address to the character storing means. Consequently, dot data of a character designated by the character code is read out of the storage area designated by the modifying data in the character storing means and is applied to the output means. In the output means, the dot data is converted into a video signal and is applied to the scan type display.

The modifying data includes character modifying data and/or color modifying data. The character modifying data is added as higher order bits of the character code to increase the number of characters which can be simultaneously displayed on one screen, and the color modifying data of, for example, two bits is applied for each character to allow a color to be designated for each dot.

According to the present invention, the restriction of the representation of a still image can be significantly relaxed, and the capability to represent an image can be significantly improved.

The foregoing and other objects, features, aspects and advantages of the present invention will become more apparent from the following detailed description of the present invention when taken in conjunction with the accompanying drawings.

BEST MODE FOR PRACTICING THE INVENTION

Figure 1:
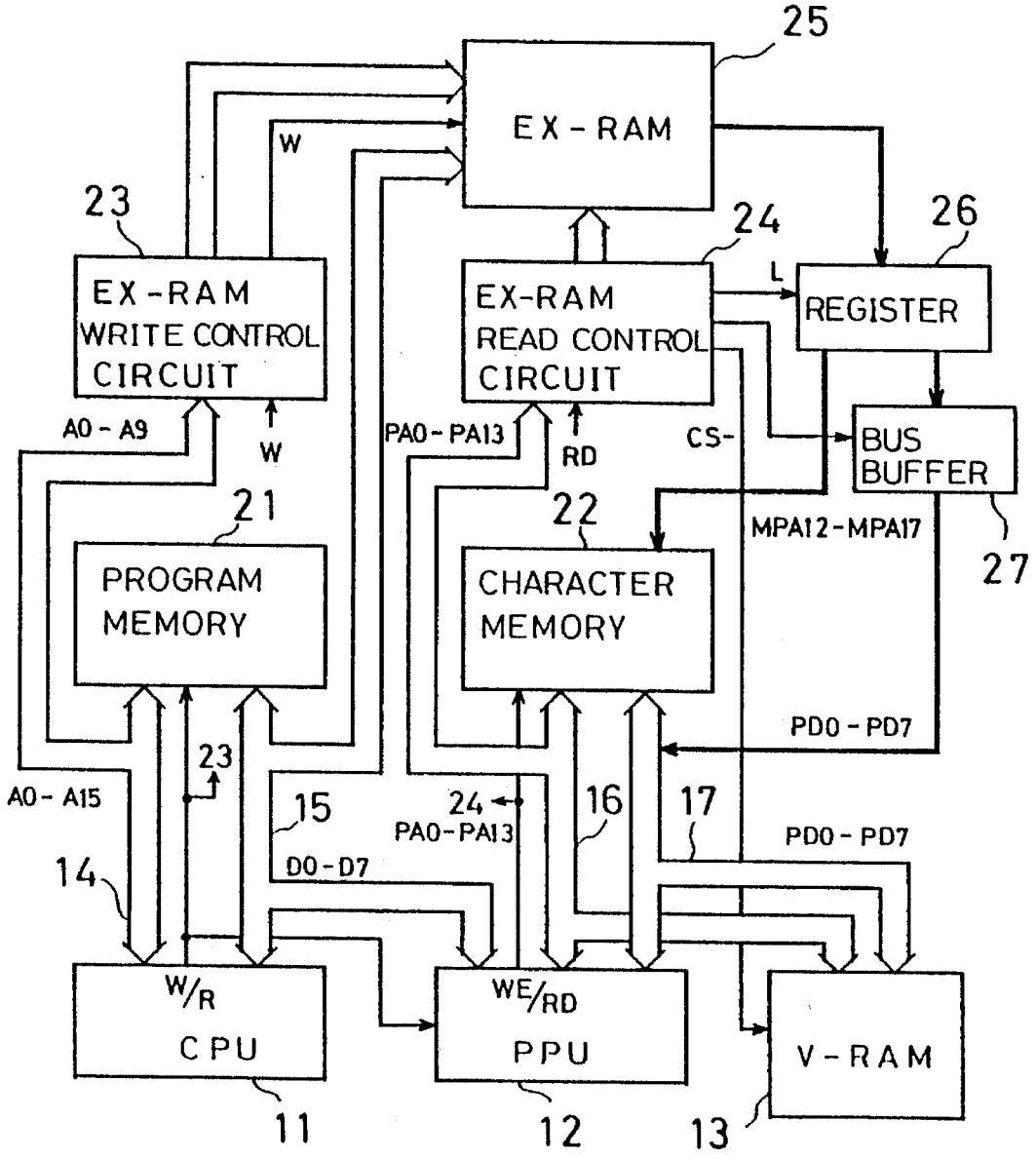
FIG. 1 is a block diagram showing in principle a still picture display apparatus according to one embodiment of he present invention.

Referring to FIG. 1, a still picture display apparatus according to the present embodiment comprises a central processing unit (referred to as "CPU" hereinafter) 11, an image processing unit (referred to as "PPU" hereinafter) 12, and a VRAM 13 which is one example of first writable/readable storing means. A program memory 21 which is one example of program storing means is connected to the CPU 11 through a CPU address bus 14 and a CPU data bus 15. The VRAM 13 as well as a character memory 22 which is one example of character storing means are connected to the PPU 12 through a PPU address bus 16 and a PPU data bus 17.

The character memory 22 is divided into storage areas each having a relatively large space, and each of the storage areas is designated by a higher order address. Dot (font) data (8×8 dots) of each of characters constituting a still picture is stored corresponding to character identification data or a character code in each of the storage areas. The character code is applied as a lower order address, thereby allowing the dot data of the character to be read out.

The program memory 21 previously stores at least first program data for writing a character code into the VRAM 13, second program data for writing modifying data into an EXRAM 25 as described later, and third program data for reading out the character code and the modifying data. The modifying data includes character modifying data when the present embodiment is applied for the purpose of increasing the number of characters, includes color modifying data when it is applied for the purpose of designating colors for each character, and includes both the character modifying data and the color modifying data when it is applied for the purposes of increasing the number of characters as well as designating colors for each character. The character modifying data is used for significantly increasing the maximum number of characters by adding higher order bits to the character code in correlation with the number of the bits as added. Color modifying data of two bits is added for each character in place of the conventional color data of two bits added for each four characters. The color of each of the dots constituting each of characters is designated by a combination of this color modifying data with color pallet data set separately therefrom.

The VRAM 13 has a plurality of coordinate addresses corresponding to character display positions on a screen of a raster scan type display (not shown). A character code of a desired character is written into each of the coordinate addresses, or the character code previously written into each of the coordinate addresses is read out.

Furthermore, a write control circuit for an extended RAM (referred to as "EXRAM" hereinafter) (referred to as "write control circuit" hereinafter) 23 which is one example of second writing means and a read control circuit for an EXRAM (referred to as "read control circuit") 24 which is one example of reading means are respectively connected to the address buses 14 and 16 of the CPU 11 and the PPU 12. In addition, the PPU 12 as well as the EXRAM 25 are connected to the data bus 15 of the CPU 11. The EXRAM 25 has a capacity capable of storing modifying data corresponding to character codes on one still picture cell stored in the VRAM 13, and is allocated addresses corresponding to the addresses of the VRAM 13. Modifying data can be written into or read out of each of the addresses. Write address data outputted from the write control circuit 23 and various signals for write control are applied to the EXRAM 25, and read address data outputted from the read control circuit 24 and various signals for read control are applied thereto. Modifying data for each character are sequentially read out of the EXRAM 25, and are loaded into a register 26 which is one example of temporary storing means.

Character modifying data (for example, lower order six bits) in the modifying data loaded into the register 26 is applied as a higher order address of the character memory 22. On the other hand, color modifying data (for example, higher order two bits) is applied to the PPU data bus 17 through a bus buffer 27 as required. Meanwhile, when no color modifying data is required or character modifying data and color modifying data are stored not only as data of one byte but also in separate addresses, the bus buffer 27 can be omitted.

Description is now made of an operation with reference to FIG. 1. In a vertical blanking period of a raster scan type display (not shown), the CPU 11 applies address data for designating a character code to the program memory 21 on the basis of a program of the program memory 21 and reads out the character code to apply the same to the PPU 12. This character code is written into a coordinate address of the VRAM 13 corresponding to a position on the screen of the raster scan type display on which the character is to be displayed. In addition, the CPU 11 applies write address data to the write control circuit 23 through the address bus 14 so as to write modifying data (character modifying data and/or color modifying data) corresponding to the character code at arbitrary timing and at the same time, applies the character modifying data and/or the color modifying data to the EXRAM 25 through the data bus 15. Correspondingly, the write control circuit 23 detects the application of an address for designating the EXRAM 25 and outputs a write signal W and at the same time, generates write address data to apply the same to the EXRAM 25. Consequently, the modifying data outputted from the above described CPU 11 is stored in the address designated by the write control circuit 23 of the EXRAM 25.

In a display period of the raster scan type display, the PPU 12 addresses the VRAM 13 in synchronization with the scanning to read out a character code. The character code is applied to the character memory 22 as a lower order address (PA0 to PA9) for reading out font data (dot data of eight dots in the horizontal direction constituting one character) in the character memory 22, and is applied to the read control circuit 24. Correspondingly, the read control circuit 24 applies to the EXRAM 25 read address data corresponding to the character code, to read out modifying data. This modifying data is temporarily stored in the register 26. Character modifying data in the modifying data stored in the register 26 is applied as a higher order address to the character memory 22. Consequently, the character memory 22 includes a memory space determined by the character modifying data applied as a higher order address, and outputs dot data addressed by the character code applied as a lower order address to apply the same to the PPU 12. In addition, the color modifying data stored in the register 26 is applied to the PPU data bus 17 through the bus buffer 27. The PPU 12 outputs a color video signal (a PGB signal or an AV signal or a television signal) on the basis of the font data and the color modifying data, to apply the same to the raster scan type display.

When the same character modifying data are written into addresses of the EXRAM 25 respectively corresponding to 32×30 coordinate addresses of the VRAM 13, the respective higher order addresses are the same. Accordingly, only 256 characters can be displayed for each still picture cell, as in the prior art.

On the other hand, if different character modifying data are stored, the respective higher order addresses are different from each other even if the character codes are the same, so that different characters are designated. For example, consider a case where $2^8$ characters are designated by character codes serving as lower order addresses. In this case, if higher order addresses of six bits are added by the character modifying data, the VRAM 13 is addressed by 14 bits. Accordingly, desired 960 (=30×32) characters can be selected from $2^{14}$ =16,384 characters and displayed on the screen.

Furthermore, when character modifying data on one screen are previously written into the EXRAM 25 and are read out in synchronization with the horizontal scanning of the raster scan type display, the higher order addresses are previously held in the register 26 and are applied to the character memory 22.

Meanwhile, according to the present embodiment, in a time period during which the EXRAM 25 does not read out modifying data, the CPU 11 can also change the modifying data.

Figure 2:
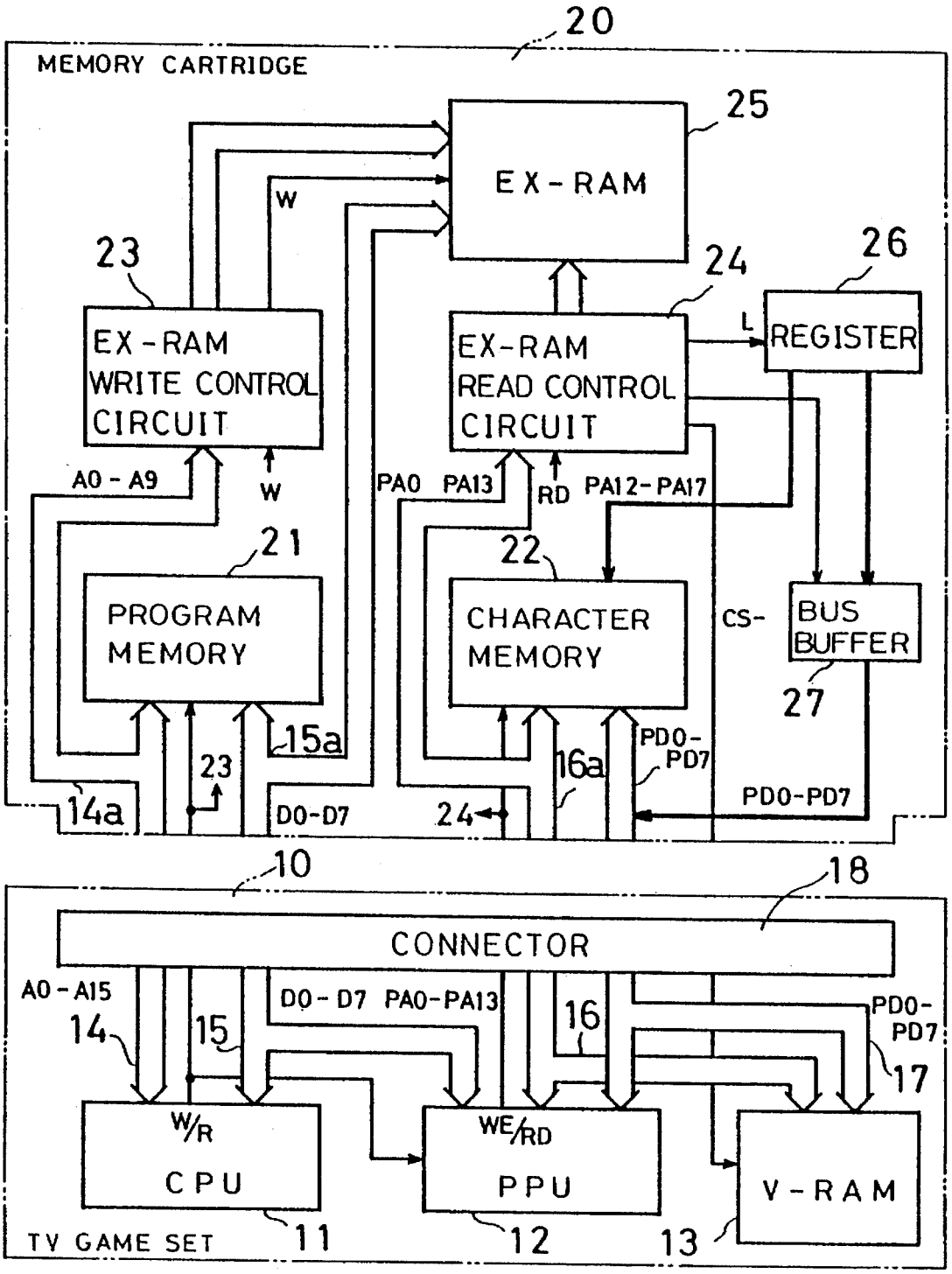
FIG. 2 is a block diagram showing in principle an external memory cartridge applied to a still picture display apparatus according to another embodiment of the present invention.

FIG. 2 is a block diagram showing in principle an external memory cartridge applied to such a still picture display apparatus. An embodiment shown in FIG. 2 is the same as the embodiment shown in FIG. 1 in that a still picture display apparatus is divided into a television game set 10 which is one example of an image processing unit and an external memory cartridge 20, and the external memory cartridge 20 is constructed detachably from the television game set 10. Consequently, the television game set 10 comprises a CPU 11, a PPU 12 and a VRAM 13, and is further provided with a connector 18 for connecting the CPU 11 and the PPU 12 to the external memory cartridge 20. The external memory cartridge 20 comprises a substrate (not shown) having a plurality of terminals electrically connected to the television game set 10 formed thereon when it is inserted into the connector 18. A program memory 21, a character memory 22, a write control circuit 23, a read control circuit 24, an EXRAM 25 and a register 26 shown in FIG. 1 are mounted on the substrate, and the respective circuits are connected through address buses 14*a* and 16*a* as well as data buses 15*a* and 17*a* and the other buses or signal lines in the same manner as that shown in FIG. 1.

According to the present embodiment, it is necessary to construct only the external memory cartridge 20 as shown in FIG. 2 and not to alter the television game set 10, thereby to make it possible to improve the capability to represent a still picture while maintaining compatibility with the television game set presently on the market.

In operation after inserting the external memory cartridge 20 into the connector 18 the use is the same as that shown in FIG. 1 and hence, the description thereof is omitted.

Figure 3:
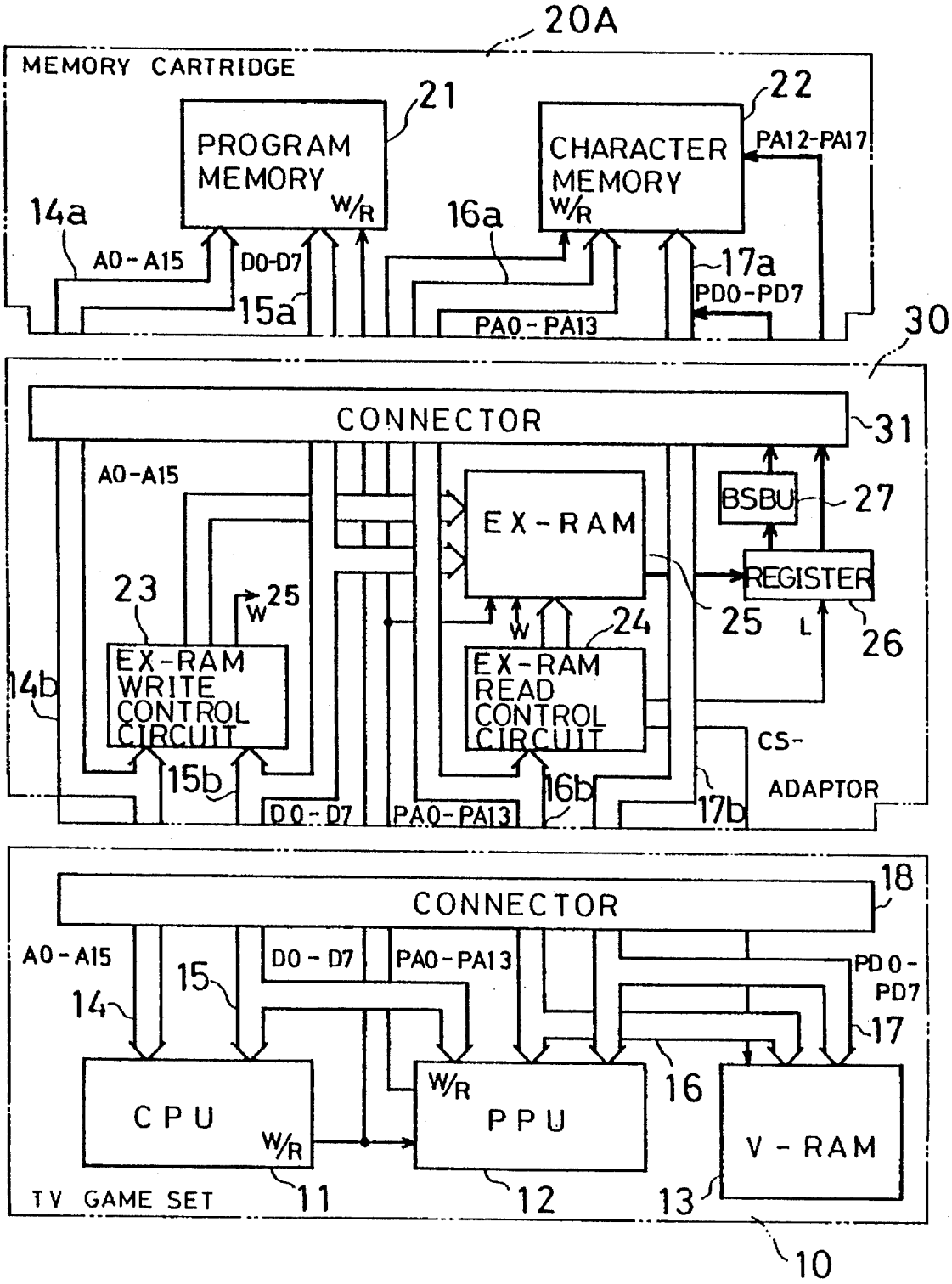
FIG. 3 is a block diagram showing in principle the system configuration of a still picture display apparatus according to still another embodiment of the present invention.
Figure 4A:
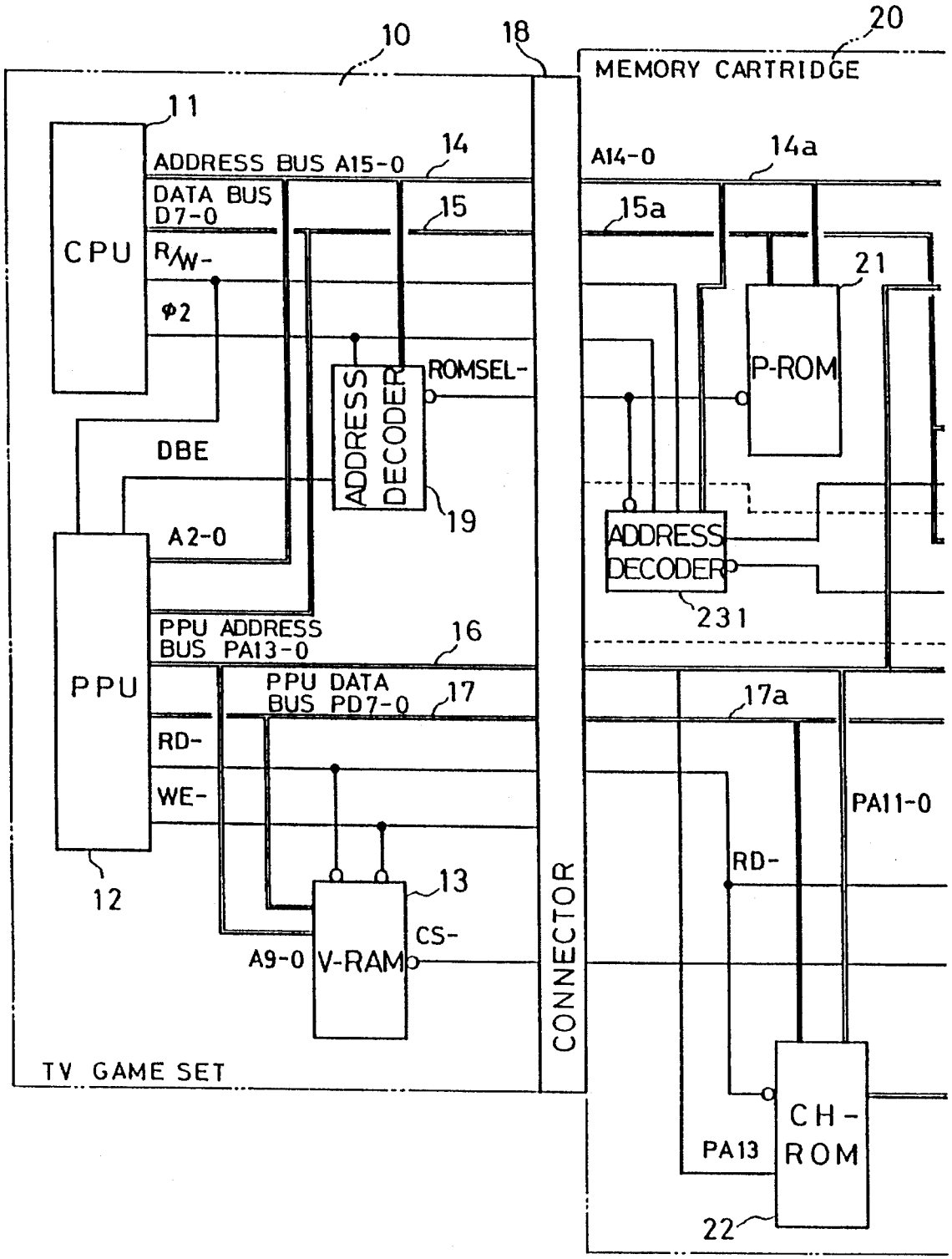
Figure 4B:
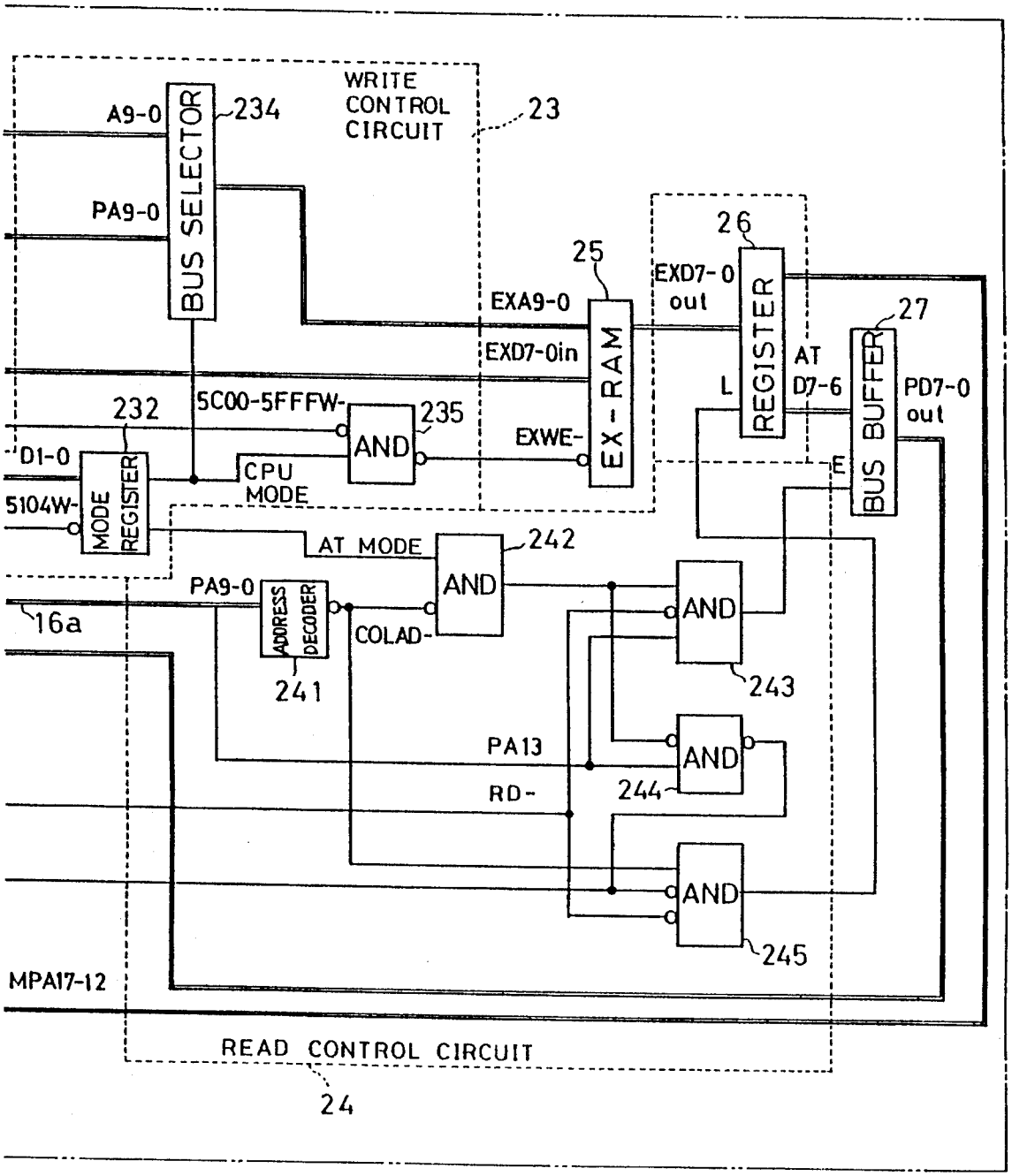

FIG. 3 is a block diagram showing still another embodiment of the present invention. The embodiment shown in FIG. 3 is the same as that shown in FIG. 1 in that a still picture display apparatus is divided into a television game set 10 which is one example of an image processing unit, and an external memory cartridge 20A and an adaptor 30, and the entire circuit is constructed by inserting the external memory cartridge 20A into the adaptor 30 with the adapter 30 being inserted into the television game set 10. Consequently, the adaptor 30 is constructed detachably from the television games set 10, and the external memory cartridge 20A is constructed detachably from the adaptor 30. A program memory 21 and a character memory 22 are provided on a substrate (not shown) in the external memory cartridge 20A in the same manner as that in the prior art. A write control circuit 23, a read control circuit 24, an EXRAM 25, a register 26 and a connector 31 are mounted on a printed board (not shown) in the adaptor 30. Consequently, in the present embodiment, a circuit equivalent to the external memory cartridge 20 shown in FIG. 2 is constructed by combining the external memory cartridge 20A and the adaptor 30.

In not only the embodiment shown in FIG. 2 but also the embodiment shown in FIG. 3, the program data stored in the program memory 21 includes modifying data and data for transferring the modifying data, as in the embodiment shown in FIG. 1.

According to the present embodiment, one adaptor 30A is shared by different external memory cartridges 20A, thereby to make it possible to achieve an improved still picture display apparatus at low cost.

Figure 4:
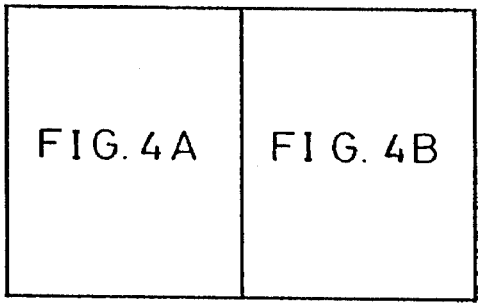
FIG. 4*a*–4*b* is a circuit diagram showing a more specific embodiment of the embodiment shown in FIG. 2.

Description is now made on a more specific embodiment with reference to FIG. 4. In FIG. 4, identical reference numerals are assigned to circuits identical or similar to those shown in FIG. 2. In the embodiment shown in FIG. 4, a television game set 10 comprises an address decoder 19 for detecting the selection of a program memory 21 on the basis of address data, unlike the embodiment shown in FIG. 2.

On the other hand, an external memory cartridge 20 comprises the same circuits as those in the embodiment shown in FIG. 2. A character memory (CH-ROM) 22 has a plurality of memory spaces each storing dot data of 256 characters. Each of the memory spaces is designated by a higher order address of six bits, and it is determined by a lower order address of eight bits which dot data in each of the memory spaces is to be designated. However, data of one character is stored in 8 bytes ×2=16 bytes so as to display the character in colors. The reason for this is as follows. More specifically, when one character is constituted by 8×8 dots, 2-bit data is required per dot assuming that one character can be displayed by freely combining four colors out of a lot of colors. Therefore, two data areas of eight bits (that is, 8 bits ×8 addresses) for displaying one character constituted by 8×8 dots are provided and are apparently overlapped with each other. The former is referred to as a front font and the latter is referred to as a back font. Font data (or dot data) for designating a color by each of two bits respectively corresponding to addresses is stored, thereby to make it possible to designate four types of data, that is, "00", "01", "10" and "11". A combination of four types of colors is selected for each character from the maximum number of colors which can be represented by the television game set 10 by color pallet data, and which color of the four colors selected by the color pallet data is to be used to display any one of the dots is determined by the above described data "00", "01", "10" and "11".

A write control circuit 23 in the external memory cartridge 20 comprises an address decoder 231, a mode register 232, an address bus selector 234 and an NAND gate 235. The address decoder 231 is used for detecting the selection of an EXRAM 25 on the basis of address data from a CPU 11 (for example, 5C00H to 5FFFH; where the last H indicates hexadecimal notation). The mode register 232 is used for storing a write mode or a read mode of the EXRAM 25. The address bus selector 234 is used for switching a write address and a read address by connecting an address bus 15 to an address bus of the EXRAM 25 in the write mode while connecting an address bus 16 to the address bus of the EXRAM 25 in the read mode. The AND gate 235 is used for detecting the write conditions of the EXRAM 25 and applying a write enable signal EXWE to the EXRAM 25.

A read control circuit 24 comprises an address decoder 241, AND gates 242, 243 and 245, and an AND gate 244. The address decoder 241 is used for detecting a color address (a color pallet selection signal) on the basis of address data from a PPU 12. The AND gate 242 is used for detecting a signal (COLAD-) representing the read mode of the EXRAM 25 and the timing when color modifying data is to be read out. The AND gate 243 enables a bus buffer 27 and provides outputs D6 to D7 of a register 26 to a data bus 17*a* as color pallet selection data provided that no output of the AND gate 242 is obtained, there is an address PA13, and the PPU 12 is performing a reading operation. The AND gates 244 and 245 are used for detecting the timing when certain character modifying data stored in the EXRAM 25 is to be loaded into the register 26.

Figure 5:
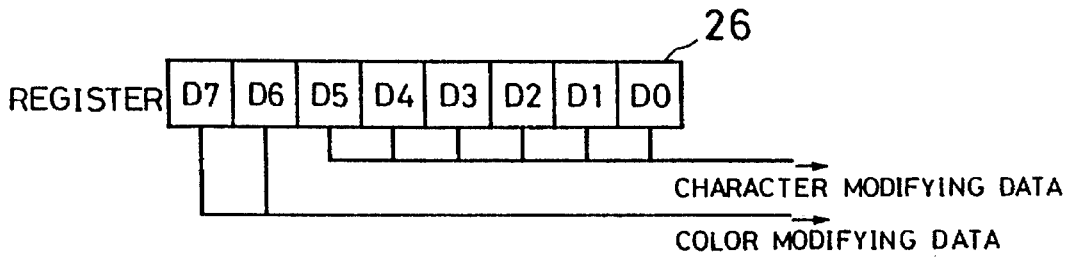
FIG. 5 is a block diagram showing the details of a register in the embodiment shown in FIG. 4.

The EXRAM 25 has a storage capacity of, for example, 1K byte, and stores character modifying data by lower order six bits (D0 to D5) in one byte and color modifying data by higher order two bits (D6 and D7) in one byte for each of characters (32×30=960) displayed on one screen. Modifying data (EXD0 to EXD7) corresponding to a character code designated by a read address is loaded into the register 26. The register 26 is used for loading character modifying data by lower order six bits (D0 to D5) and loading color modifying data by higher order two bits (D6 and D7), as shown in FIG. 5. The character modifying data in the modifying data loaded into the register 26 is applied as a higher order address (MPA12 to MPA17), and the color modifying data is applied to the bus buffer 27.

Figure 6:
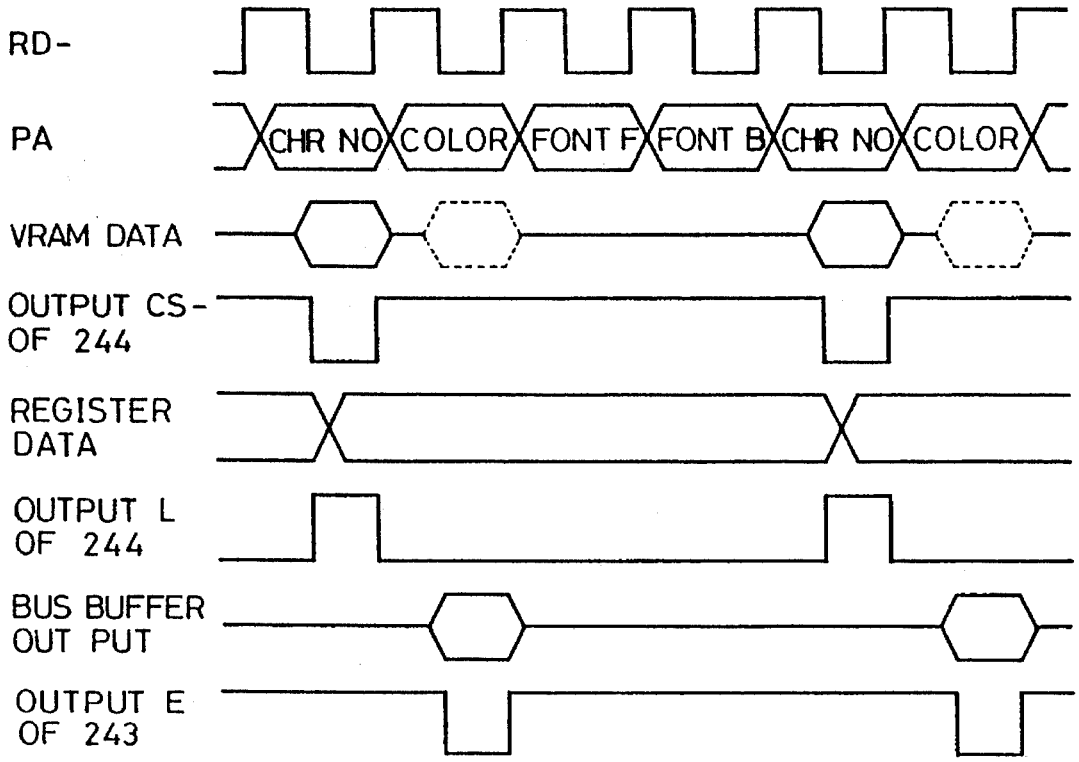
FIG. 6 is a timing chart showing a reading operation by a PPU.

Referring now to FIGS. 4 to 6, description is made of an operation of the embodiment shown in FIG. 4.

First, description is made of the write mode. An operation of the CPU 11 and the PPU 12 writing character codes to be displayed on one still picture cell into coordinate addresses of a VRAM 13 on the basis of first program data of the program memory 21 is performed during a vertical blanking period of a raster scan type display in the same manner as the operation described in the embodiment shown in FIG. 2.

The details of an operation of the CPU 11 writing modifying data (character modifying data and/or color modifier data) corresponding to a character code to the EXRAM 25 at arbitrary timing are as follows. More specifically, the CPU 11 applies a selection signal of the program memory 21 to the address decoder 19 and applies address data for reading out second program data from the program memory 21. The CPU 11 outputs an address (for example, 5104H) for designating the mode register 232 and mode data (D0 to D1) representing the write mode on the basis of the second program data. Correspondingly, the address decoder 231 applies a write signal to the mode register 232, so that the mode register 232 loads data for designating the write mode. The mode register 232 applies a signal representing a write (CPU) mode to the address bus selector 234 and the AND gate 235, so that the address bus selector 234 is switched to the side of a CPU address bus 14*a*.

Subsequently, the CPU 11 applies write address data of the EXRAM 25 to the address bus selector 234 through an address bus 14, and applies character modifying data and/or color modifying data as write data to the EXRAM 25 through the data bus 15. At this time, a write enable signal from the AND gate 235 is applied to the EXRAM 25. Accordingly, the modifying data is written into the designated address of the EXRAM 25. The foregoing operation of writing modifying data is sequentially performed with respect to all display coordinate positions on one screen (that is, 32×30=960 display coordinate positions).

Description is now made of an operation in a display mode. In a display period of the raster scan type display, the CPU 11 outputs an address for designating the mode register 232, so that the address decoder 231 applies a write signal to the mode register 232. Subsequently, read mode data is applied to the mode register 232 from the CPU 11, so that this data is loaded into the mode register 232. Therefore, the mode register (232) switches the address bus selector 234 to the side of a PPU address bus 15*a*, and applies a signal representing the read mode as one input of the AND gate 242.

Thereafter, the PPU 12 sequentially reads out for each character a character code, color modifying data, data of eight dots in the horizontal direction for the front font constituting the designated character, and data of eight dots in the horizontal direction for the back font constituting the character in synchronization with the horizontal scanning of the laster scan type display, as shown in FIG. 6. Meanwhile, the character modifying data is read out at the same timing as the timing when a character code is to be read out.

Description is now made of a more specific operation in outputting font data of one character. The PPU 12 brings the address PA13 for designating the VRAM 13 into a high level and at the same time, applies the address PA13 to the character memory 22, the address bus selector 234 and the address decoder (241) as a lower order address (PA0 to PA11) for designating a character code through address buses 16 and 16*a*. Correspondingly, the address decoder 241 and the AND gate 242 detect the timing when no color modifying data is to be read out, and the AND gate 244 applies an enable signal (CS-) to the VRAM 13, so that the character code is read out by the PPU 12 in synchronization with a read signal (RD-). On the other hand, the enable signal (CS-) of the AND gate 244 is also applied to the AND gate 245. Since an output (COLAD-) of the address decoder 241 is not in an enable state, the AND gate 245 generates a latch command signal (L) to the register 26 in synchronization with the read signal. Character modifying data and color modifying data are loaded into the register 26 in response to this latch command signal.

Subsequently, the PPU 12 outputs a read signal (RD-) and at the same time, applies a character code to the character memory 22 as a lower order address (PA0 to PA9) through the address buses 16 and 16*a*. At the same time, character modifying data loaded into the register 26 (for example, MPA 12 to 17) is applied to the character memory 22 as a higher order address.

At the next timing, the PPU 12 applies address data for designating reading of color selection data to the address decoder 241 as a lower order address (PA0 to PA11) through the address buses 16 and 16*a*. Correspondingly, the address decoder 241 detects the timing when color modifying data is to be read out, and the AND gates 242 and 243 apply an enable signal (E) to the bus buffer 27 in synchronization with the read signal, so that color modifying data is applied to the PPU 12 in synchronization with the read signal (RD-). At that time, however, an output (a selection signal CS-) of the AND gate 242 is in an inactive state, so that the VRAM is not enabled.

As a result, a character is selected by a combination of the higher order address designated by the character modifying data and the lower order address designated by a PPU address, so that data of the character on one line for the front font and the back font (dot data of eight dots in the horizontal direction constituting one character) is read out and is applied to the PPU 12. In addition, two bits (D6 and D7) of the color modifying data in the modifying data loaded into the register 26 are extended to eight bits by the bus buffer 27 and are applied to the PPU 22 through the PPU data buses 17*a* and 17. Consequently, the PPU 12 generates a color video signal on the basis of data of two bits per dot for the front font and the back font and outputs the same to the raster scan type display (not shown).

The foregoing reading or outputting operation is repeated for each character in synchronization with the horizontal scanning of the raster scan type display during one frame period.

Figure 7:
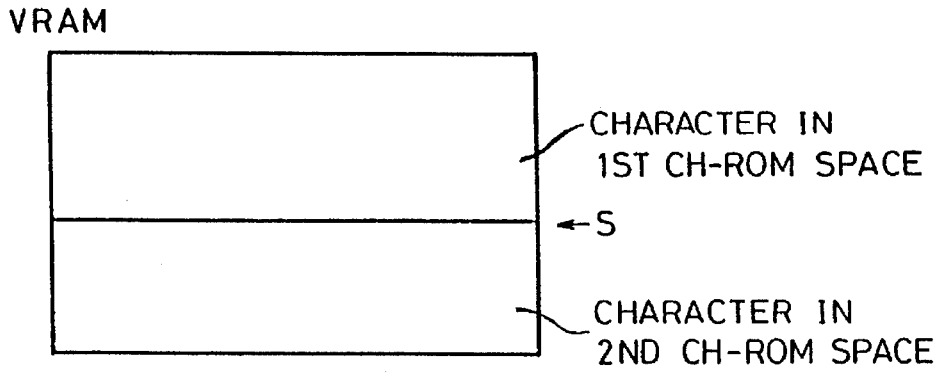
FIG. 7 is an illustration showing the effect of the embodiment shown in FIG. 4 in comparison with the conventional bank switching.
Figure 8:
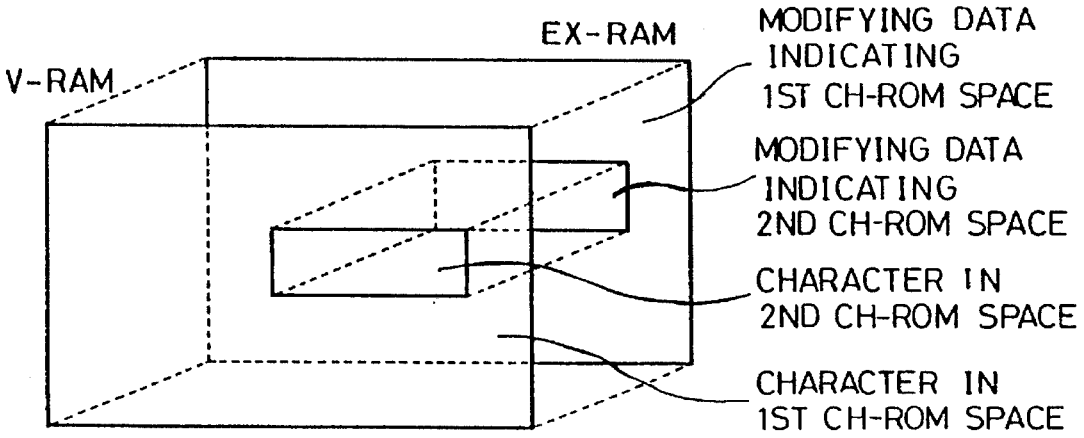
FIG. 8 is an illustration showing the effect of extending data for designating a character by adding character modifying data for each display coordinate position.

As described in the foregoing, according to the present embodiment, data for designating a character can be extended to 14 bits by adding 6-bit character modifying data, and character modifying data can be arbitrarily selected for each display coordinate position, thereby to make it possible to extend the number of characters which can be used on one screen to $2^{14}$=16384. Moreover, the present embodiment has advantages superior to the conventional bank switching technique. More specifically, in the conventional bank switching technique, the PPU 12 must regularly monitor bank switching timing (S) so as to switch banks from the beginning of the next horizontal scanning, as shown in FIG. 7. On the other hand, according to the present embodiment, no monitoring of bank switching timing is required, thus decreasing the burden on the PPU 12. In addition, as illustrated in FIG. 8, the EXRAM 25 for storing modifying data corresponding to a display coordinate position for each character is used, thereby to make it possible to freely select a higher order address, that is, a memory space for each character as well as to select desired 960 (=30×32) characters out of the maximum types of characters which can be displayed on one screen.

Although the present invention has been described and illustrated in detail, it is clearly understood that the same is by way of illustration and example only and is not to be taken by way of limitation, the spirit and scope of the present invention being limited only by the terms of the appended claims.

What is claimed:

1. A still picture display apparatus for displaying a plurality of characters constituting a still picture on a screen of a scan type display in a text system, comprising:

a character storing device including a plurality of storage areas each designated by a higher order address and one of a plurality of character codes applied as a lower order address and storing dot data of a character;

a first writable/readable storing element having a plurality of first coordinate addresses each of which correspond to each display coordinate position on said scan type display and capable of writing or reading one of said character codes to or from each of the first coordinate addresses;

a second writable/readable storing element having a plurality of second coordinate addresses each of which correspond to each display coordinate position on said scan type display for storing in each of the second display coordinate addresses character modifying data;

a first writing device for writing into each of said addresses of said first writable/readable storing element character codes of desired characters to be displayed on the screen of said scan type display during a non-display period of said scan type display;

a second writing device for writing into each of said addresses of said second writable/readable storing element character modifying data corresponding to each character code written into said first writable/readable storing element;

a program storing element storing first program data for controlling said first writing device so as to write said character codes into said first writable/readable storing element for each display coordinate position of the scan type display, second program data for controlling said second writing device so as to write said character modifying data into said second writable/readable storing element for each display coordinate position of the scan type display, and third program data for controlling a second reading device and a first reading device so as to respectively read one of said character codes and one of said character modifying data out of corresponding first and second coordinate addresses of said first writable/readable storing element and said second writable/readable storing element for each desired character to be displayed;

said first reading device reading out character modifying data stored in said second writable/readable storing element during a display period of said scan type display;

said second reading device reading out a complete character code stored in said first writable/readable storing element during the display period of said scan type display;

a third reading device for reading out said dot data of the character by addressing said character storing device by said complete character code read out by said second reading device and said character modifying data read out by said first reading device; and an output element for outputting a video signal for displaying said character on the basis of said dot data read out by said third reading device in synchronization with the scanning of said scan type display.

2. A still picture display apparatus according to claim 1, wherein said character storing device stores said dot data as data which can designate colors of respective dots constituting said character, said second writable/readable storing element includes an address for further storing color modifying data for each of said second coordinate addresses corresponding to the display coordinate positions on said scan type display, and said second program data stored in said program storing element includes a program for writing said color modifying data into said second writable/readable storing element, and said output element outputs a color video signal on the basis of the color modifying data read out of said second writable/readable storing element and said dot data read by said third reading device out of said character storing device.

3. The still picture display apparatus according to claim 1 wherein said character storing device, second writable/readable storing element, second writing device and first reading device are included in an external memory cartridge which is detachably mounted to a device including said first writable/readable storing element, first writing device, second reading device, third reading device and said output element.

4. The still picture display apparatus according to claim 1 comprising a device including said first writable/readable storing element, first writing device, second reading device, third reading device and output element;

an adaptor detachably mounted to said device and including said second writable/readable storing element, second writing device and first reading device, and an external memory cartridge detachably mounted to said adaptor and including said character storing device, whereby different external memory cartridges can be mounted to said adaptor.

5. A still picture display apparatus as in claim 1 further including a central processing unit, a picture processing unit and a connector terminal element, said program storing element and said central processing unit being connected to the connector terminal element by a data bus and an address bus, said picture processing unit, which includes the first writing device, the second and third reading devices and said output element, being connected along with said first writable/readable storing element to the connector terminal element by another data bus and another address bus, whereby said central processing unit applies address data to the program memory for causing the program memory to control the first writing device to write said character code into said first writable/readable storing element.

6. A still picture display apparatus as in claim 5 wherein said second writing means is connected to the connector terminal element by said data bus and said address bus whereby said central processing unit applies address data to the program memory for causing the program memory to control the second writing means for writing data into the second writable/readable storing element.

7. A still picture display apparatus for displaying in colors a plurality of characters constituting a still picture on a screen of a scan type display in a text system, comprising:

a character storing device including a plurality of color data for each of the dots constituting a character stored in a storage position designated by one of a plurality of character codes for each of the storage positions and said character code being applied as an address;

a first writable/readable storing element having a plurality of first coordinate addresses, each of which corresponds to each display coordinate position on said scan type display and capable of writing or reading one of said character codes to or from each of the first coordinate addresses;

a second writable/readable storing element having a plurality of second coordinate addresses, each of which corresponds to each display coordinate position on said scan type display for storing in each of the second display coordinate addresses color modifying data for modifying said color data of said characters stored in said character storing device;

a first writing device for writing into each of said addresses of said first writable/readable storing element character codes of desired characters to be displayed on the screen of said scan type display during a non-display period of said scan type display;

a second writing device for writing into each of said addresses of said second writable/readable storing element color modifying data corresponding to each character code written into said first writable/readable storing element;

a program storing element storing first program data for controlling said first writing device so as to write said character codes into said first writable/readable storing element for each display coordinate position of the scan type display, second program data for controlling said second writing device so as to write said color modifying data into said second writable/readable storing element for each display coordinate position of the scan type display, and third program data for controlling a second reading device and a first reading device so as to respectively read one of said character codes and one of said color modifying data out of said first writable/readable storing element and said second writable/readable storing element for each desired character to be displayed;

said first reading device reading out color modifying data stored in said second writable/readable storing element during a display period of said scan type display;

said second reading device reading out a complete character code stored in said first writable/readable storing element during the display period of said scan type display;

a third reading device for reading out color data of the character corresponding to a character code stored in said character storing device on the basis of said complete character code; and an output element for outputting a color video signal for displaying said character on the basis of said color data read out by said third reading device in synchronization with the scanning of said scan type display.

8. An external memory cartridge detachably mounted on a still picture display apparatus for displaying a plurality of characters constituting a still picture on a screen of a scan type display in a text system and the apparatus including a first writable/readable storing element having a plurality of first coordinate addresses, each of which corresponds to each display coordinate position on said scan type display and capable of writing or reading a character code to or from each of the first coordinate addresses, said external memory cartridge comprising:

a character storing device including a plurality of storage areas each designated by a higher order address and one of a plurality of character codes applied as a lower order address and storing dot data of a character;

a second writable/readable storing element having a plurality of second coordinate addresses, each of which corresponds to each display coordinate position on said scan type display for storing in each of the second display coordinate addresses character modifying data;

a program storing element storing first program data for controlling a first writing device so as to write said character codes into said first writable/readable storing element for each display coordinate position of the scan type display, second program data for controlling a second writing device so as to write said character modifying data into said second writable/readable storing element for each display coordinate position of the scan type display, third program data for controlling a second reading device and a first reading device so as to respectively read one of said character codes and one of said character modifying data out of corresponding first and second coordinate addresses of said first writable/readable storing element and said second writable/readable storing element for each desired character to be displayed, a character code of a desired character to be displayed on the screen of said scan type display being written into said first writable/readable storing element on the basis of said first program data during a non-display period of said scan type display;

said second writing device for writing into said second writable/readable storing element character modifying data corresponding to the desired character code written into said first writable/readable storing element on the basis of said second program data; and said first reading device for reading out the character modifying data stored in said second writable/readable storing element on the basis of said third program data during a display period of said scan type display;

said still picture display apparatus further comprising a control element for reading out the character code stored in said first writable/readable storing element on the basis of said third program data during the display period of said scan type display and a third reading device for reading out said dot data of the character by addressing said character storing device by the lower order address provided by said character code read out by said second reading device and the higher address provided by said character modifying data read out by said first reading device, and an output element for outputting a video signal for displaying said desired character to be displayed on the basis of said dot data read out by said third reading device in synchronization with the scanning of said scan type display.

9. An external memory cartridge according to claim 8, wherein said character storing device stores said dot data as data which can designate colors of respective dots constituting said character, said second writable/readable storing element includes an address for further storing color modifying data for each of said second coordinate addresses corresponding to the display coordinate positions on said scan type display, and said second program data stored in said program storing element includes a program for writing said color modifying data into said second writable/readable storing element, and said output element outputs a color video signal on the basis of the color modifying data read out of said second writable/readable storing element and said dot data read by said third reading device out of said character storing means.

* * * * *